US009099233B2

(12) United States Patent
Aronson et al.

(10) Patent No.: US 9,099,233 B2
(45) Date of Patent: Aug. 4, 2015

(54) INTERFACE COLLOIDAL ROBOTIC MANIPULATOR

(75) Inventors: Igor Aronson, Darien, IL (US); Oleksiy Snezhko, Naperville, IL (US)

(73) Assignee: UChicago Argonne, LLC, Chicago, IL (US)

( * ) Notice: Subject to any disclaimer, the term of this patent is extended or adjusted under 35 U.S.C. 154(b) by 744 days.

(21) Appl. No.: 13/200,494

(22) Filed: Sep. 23, 2011

(65) Prior Publication Data

US 2013/0075648 A1 Mar. 28, 2013

(51) Int. Cl.

| | |
|---|---|
| ***H01F 1/44*** | (2006.01) |
| ***B03C 1/28*** | (2006.01) |
| ***B03C 1/033*** | (2006.01) |

(52) U.S. Cl.

CPC ..... *H01F 1/447* (2013.01); *B03C 1/0335* (2013.01); *B03C 1/288* (2013.01); *B03C 2201/18* (2013.01)

(58) Field of Classification Search

CPC ..... G01F 1/447; B03C 1/288; B03C 1/0335; B03C 2201/18

USPC ..... 204/557, 664; 210/695, 222; 435/173.9

See application file for complete search history.

(56) References Cited

U.S. PATENT DOCUMENTS

| | | | | |
|---|---|---|---|---|
| 7,875,187 | B2 | 1/2011 | Snezhko et al. | |
| 2006/0197052 | A1 | 9/2006 | Pugel | |
| 2008/0014442 | A1 * | 1/2008 | Rida | 204/557 |
| 2011/0262893 | A1 * | 10/2011 | Dryga et al. | 435/173.9 |

OTHER PUBLICATIONS

Snezhko, A., et al., "Dynamic Self-Assembly of Magnetic Particles on the Fluid Interface-Wave-Mediated Effective Magnetic Exchange", Physical Review E 73, 041306 (2006).

Snezhko, A. et al., "Structure Formation in Electronagnetically Driven Granular Media", Physical Review Letters, PRL 94, 108002 (2005).

Snezhko, A. et al., "Surface Wave Assisted Self-Assembly for Multidomain Magnetic Structures", Physical Review Letters, PRL 96, 078701 (2006).

* cited by examiner

*Primary Examiner* — David A Reifsnyder

(74) *Attorney, Agent, or Firm* — Foley & Lardner LLP

(57) ABSTRACT

A magnetic colloidal system confined at the interface between two immiscible liquids and energized by an alternating magnetic field dynamically self-assembles into localized asters and arrays of asters. The colloidal system exhibits locomotion and shape change. By controlling a small external magnetic field applied parallel to the interface, structures can capture, transport, and position target particles.

18 Claims, 17 Drawing Sheets
(16 of 17 Drawing Sheet(s) Filed in Color)

Figure 1a
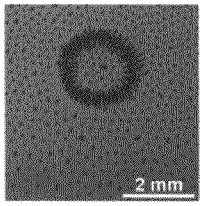
Figure 1b
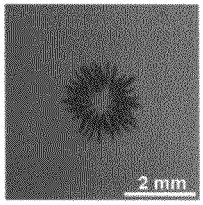
Figure 1c
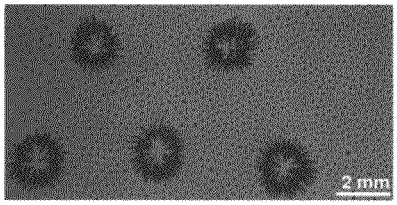
Figure 1d
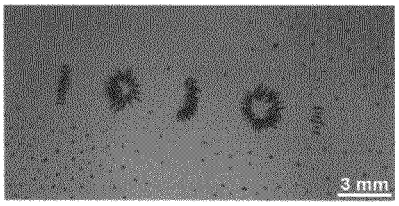
Figure 1e
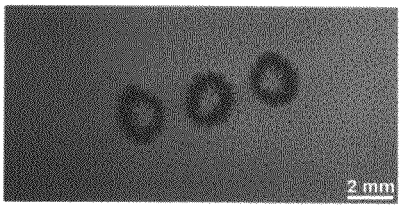
Figure 1f
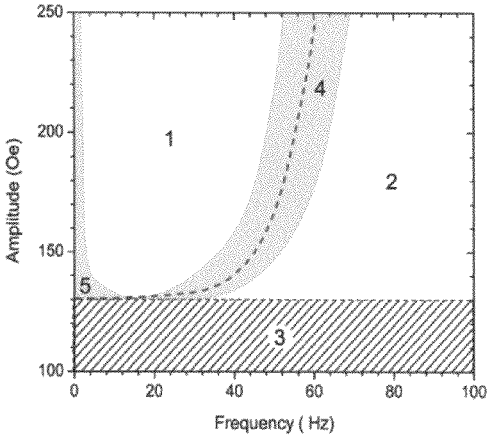
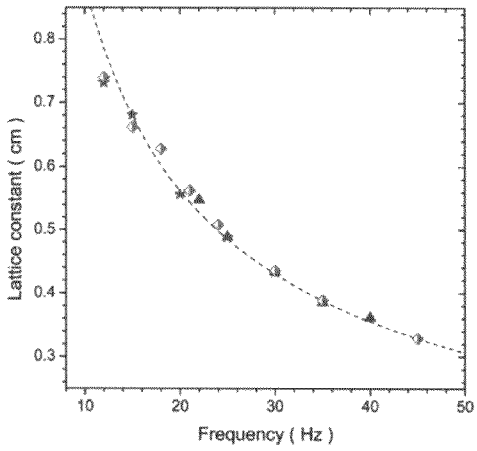
Figure 1g Figure 2a
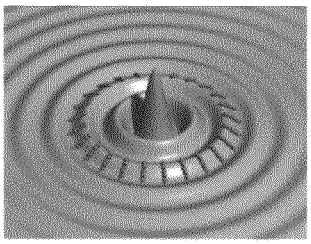
Figure 2b
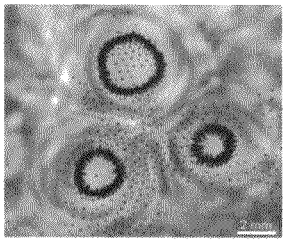
Figure 2c
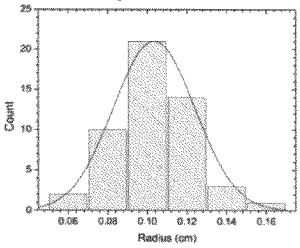
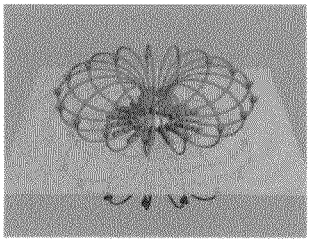
Figure 2d
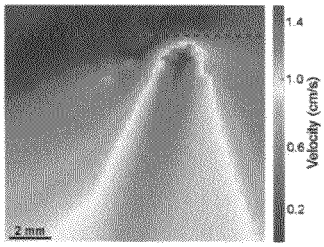
Figure 2e
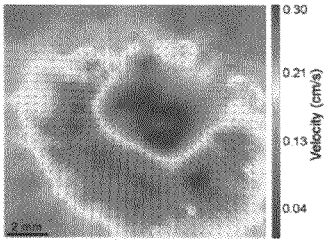
Figure 2f Figure 3a
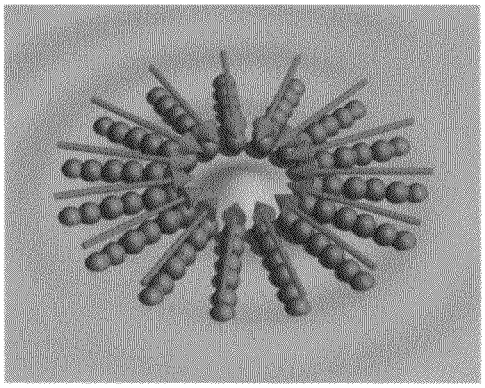
Figure 3b
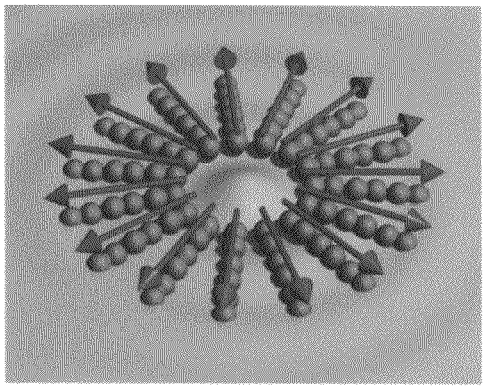
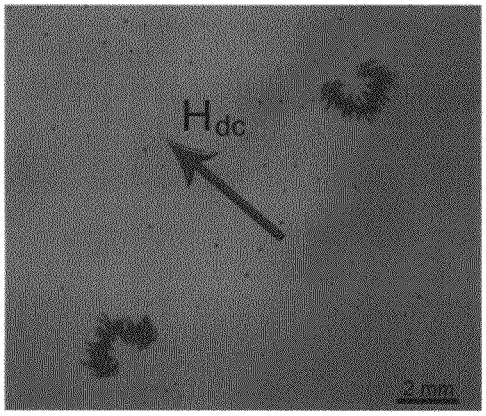
Figure 3c
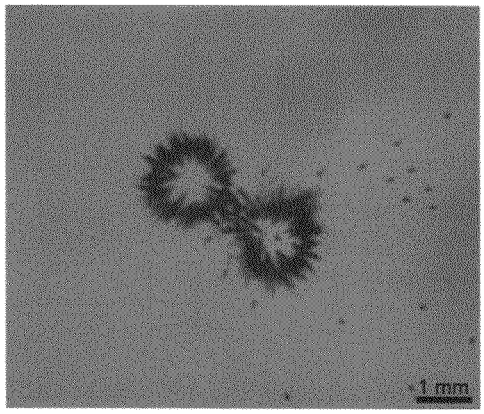
Figure 3d t = 0 t = 3.12 s t = 7.04 s t = 9.60 s

INTERFACE COLLOIDAL ROBOTIC MANIPULATOR

STATEMENT OF GOVERNMENT INTEREST

The United States Government claims certain rights in this invention pursuant to Contract No. DE-AC02-06CH11357 between the United States Department of Energy and UChicago Argonne, LLC, representing Argonne National Laboratory.

FIELD OF THE INVENTION

The present invention generally relates to self-assembled structures. Specifically to interface colloidal robotic manipulators.

BACKGROUND OF THE INVENTION

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Researchers in various disciplines have attempted to capture and hold motile and highly-diffusive objects such as viruses, small colloids, and bacterial. The small size of such objects, as well as the environment in which they are found has presented problems in efficient and repeatable systems and methods for transporting objects.

Current systems utilize complex laser systems to attempt to orient, position, and manipulate small objects. Optical tweezer systems have been developed to utilize light directed through an objected lens to manipulate an object in three-dimensional space.

SUMMARY OF THE INVENTION

One embodiment of the invention relates to a system for manipulating particle. The system comprises a first liquid and a second liquid that are immiscible. Magnetic microparticles dispersed at the interface of the two immiscible liquids. A magnetic source positioned to apply an alternating magnetic field to the dispersed magnetic microparticles.

One embodiment of the invention relates to a self assembling structure comprising a plurality of magnetic microparticles suspended at a liquid-liquid interface. The plurality of magnetic microparticles arranged by dipole-dipole magnetic interactions with an external magnetic field. The structure further comprises a deformation resulting in a non-symmetrical shape of the self assembled structure.

One embodiment of the invention relates to a method for magnetic manipulation of self-assembled colloidal asters comprising: suspending magnetic particles at an interface between two immiscible liquids; energizing the ferromagnetic suspension by application of a vertically positioned ac magnetic field; forming chains of magnetic particles; rocking the chains of magnetic particles by action of the ac magnetic field; deforming the interface; and generating a hydrodynamic streaming flow associated with the chains of magnetic particles.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The patent or application file contains at least one drawing executed in color. Copies of this patent or patent application publication with color drawing(s) will be provided by the Office upon request and payment of necessary fee.

The foregoing and other objects, aspects, features, and advantages of the disclosure will become more apparent and better understood by referring to the following description taken in conjunction with the accompanying drawings, in which:

FIG. 1*a-g* illustrate self-assembled dynamic asters. FIGS. 1*a* and 1*b* are micrographs showing asters formed in a liquid-liquid interface with the frequencies of the ac magnetic field being 20 and 30 Hz, respectively, wherein the typical diameter of the asters decreases as the frequency of the ac magnetic field increases. FIGS. 1*c*-1*e* are micrographs showing asters self-assemble into more complex structures including membranes (c), linear hybrids composed of asters alternating with linear segments (d), and linear trains (e). FIG. 1*f* is a phase diagram illustrating different states of an active magnetic colloid versus magnitude of the ac magnetic field, wherein region 1 depicts asters; region 2 corresponds to linearly ordered structures (magnetic snakes); particles form dense clusters when in Regions 3 and 5; region 4 indicates a wide hysteretic domain where asters co-exist with linear segments. FIG. 1*g* is a graph of frequency dependence of the lattice constant for lattice formed by asters, wherein the dashed line shows the dispersion relation (Eq. 1) for interfacial waves.

FIGS. 2*a*-2*f* illustrate structure and hydrodynamic signature of asters. FIG. 2*a* illustrates schematics of a self-assembled aster, wherein chains of microparticles decorate the slope of a circular standing wave. FIG. 2*b* is a micrograph showing a cluster formed by three distinctly different asters observed at the frequency of the ac magnetic field 15 Hz demonstrating that chains can occupy different slopes of the same wave giving rise to a wide size distribution of asters. FIG. 2*c* is a graph of observed size distribution of asters is close to a normal distribution, where the data was collected for asters generated at 15 Hz. FIG. 2*d* illustrates self-induced hydrodynamic flows generated by the aster, wherein toroidal flows accompany each aster with the liquid jets pointing perpendicular to the interface. FIG. 2*e* is a velocity profile of the flow created by an aster in the bottom liquid layer (vertical slice) obtained by particle image velocimetry (PIV), wherein the dashed line depicts the position of the interface, frequency of the ac magnetic field 15 Hz. FIG. 2*f* illustrates a horizontal slice of the flow velocity generated by the aster wherein the arrows show flow direction (the slice was taken 0.5 mm below the interface).

FIGS. 3*a-d* show magnetic ordering of asters. FIG. 3*a* illustrates an aster with magnetic moments pointing towards the center. FIG. 3*b* illustrates an anti-aster with magnetic moments pointing outwards. FIG. 3*c* is a micrograph of the response of an aster (top) and anti-aster (bottom) to a 14 Oe in-plane magnetic field; frequency of the ac magnetic field is 25 Hz. FIG. 3*d* is a micrograph of an aster and anti-aster, when located close to each other, exchange particles due to dipole-dipole attractive forces between their chains.

FIG. 4*a*, illustrates swimming speed as a function of in-plane magnetic field for the frequency of the ac magnetic field set to 15 Hz. Solid line shows theoretical prediction. The micrographs show shape distortion of the aster as a response to an in-plane magnetic field. An in-plane field below 2 Oe causes only an asymmetric deformation of the aster. A field above 2 Oe opens the aster up; the aster transforms into a parallel segment at a critical field about 22 Oe, b In-plane magnetic field is used to perform gripper functions (capture of 1 mm glass bead is demonstrated, the ac magnetic field frequency was 20 Hz). Representative values of the forces and torques exerted by the aster on a 1 mm bead are $10^{-6}$ N and $10^{-9}$ Nm respectively. Small black dots are the same magnetic particles that form the aster.

FIG. 5*a* is a micrograph of a cluster of four asters transported towards the target particles (in-plane magnetic field 10 Oe). FIGS. 5*b* and 5*c* are micrographs showing the flow generated by the cluster (the flow is schematically illustrated by black arrows and is qualitatively close to the supposition of the flows of the individual asters) sucks in and encages particles in the interstitial space between four individual asters. FIG. 5*d* is a micrograph showing the cluster with encaged particles is returned to its initial location.

FIG. 8*a* Hac=100 Oe; 50 Hz. FIG. 11*b* Hac=110 Oe, 60 Hz. FIG. 11*c* illustrates the quadrupole vortex structure observed. Each tail generates a pair of counter rotating vortices. The flow velocity was observed as 5 cm/sec.

FIG. 9 *a* illustrates a micrograph of the assembled structure. The tail of the pump operates to create fluid flow. The fluid velocity will increase with frequency. FIG. 9*b* illustrates the flow velocity profile of the pump of FIG. 9*a*. FIG. 9*c* is a graph of vortex strength vs frequency of driving.

DETAILED DESCRIPTION OF THE PREFERRED EMBODIMENTS

Figure 4A:
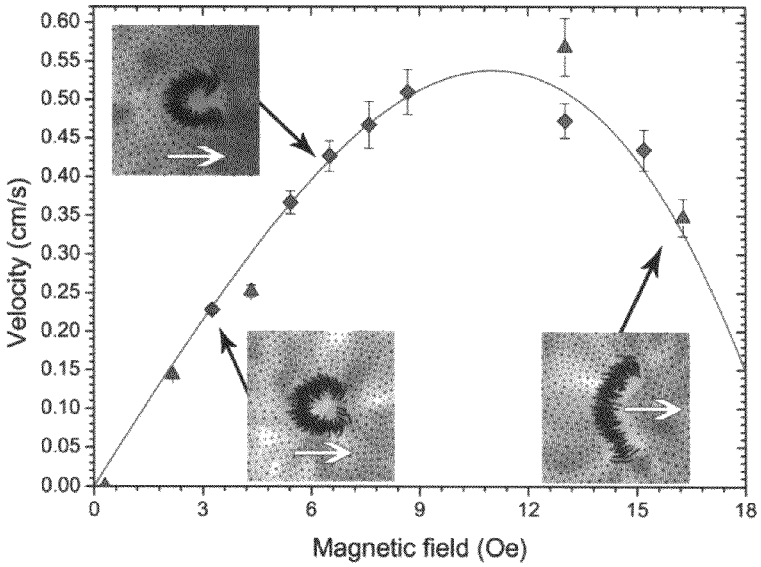
FIGS. 4*a* and 4*b* show controlled locomotion and gripper functionality of asters.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Self-assembly gives rise to materials that are far more complex than traditional metals, ceramics, and polymers with many levels of functionality, hierarchical organization, and compartmentalization. However, self-assembled materials pose a formidable challenge in that they are intrinsically complex, with organization often occurring on many nested length and time scales. It is practical to identify two major classes of self-assembling systems: static and dynamic. A static self-assembly involves systems that are at global or local equilibrium and do not dissipate energy. In a dynamic self-assembly observed out of equilibrium, the interactions responsible for the formation of structures occur only if the system actively consumes energy from an external energy source, provided, for example, by an applied field or chemical reaction. Resulting dynamic structures are not usually accessible under equilibrium conditions. Active colloidal suspensions are both promising candidates for understanding the guiding principles of dynamic self-assembly and convenient platforms for the design of new functional self-assembled structures; this is largely because of their controllability, size and diverse range of interactions.

The present invention relates to structures exhibiting self-assembly, in a specific embodiment, self assembly via a ferromagnetic colloidal suspension placed at the interface (boundary) between two immiscible liquids and energized by a uniform alternating (a.c.) magnetic field. The magnetic field is applied perpendicular to the interface between the liquids, and it provides an energy source that drives the system out of equilibrium; it also functions as a convenient knob to control the emerging architectures. In one embodiment, if the magnetic field is not strictly perpendicular to the interface, the emerging structures become asymmetric and generally drift towards container wall; the drift can be neglected if the field is vertical within several degrees In accordance with the present invention, magnetic colloids, confined at the interface between two immiscible liquids and energized by an alternating magnetic field, form a variety of complex dynamic self-assembled structures, including localized asters and tunable array of asters. Aster is a description of the shape of the structures having a similarity with the flower aster. This embodiment of the self-assembled structure is called aster because the magnetic chains radiate from the center Amongst the striking new features of these structures are the ability to change shape and control locomotion in response to external stimuli. Asters and aster arrays are capable of performing simple manipulations capturing transporting, and positioning particles. Embodiments of the present invention give new insights into the engineering of "smart" synthetic materials by means of dynamic self-assembly and new design concepts for "soft robotics".

The systems and method of the present invention provide for a remarkable diversity of dynamic self-assembled structures. In one embodiment, shown in FIGS. 1*a* and 1*b*, localized asters emerge at the interface as a result of the interaction between the interface's excitations and a collective response of the magnetic colloidal particles. FIGS. 1*a* and 1*b* are micrographs showing asters formed in a liquid-liquid interface with the frequencies of the ac magnetic field being 20 and 30 Hz, respectively, wherein the typical diameter of the asters decreases as the frequency of the ac magnetic field increases. In one embodiment, the magnetic field frequency could vary depending on parameters of liquids and/or the size of the particles. In a particular embodiment, the magnetic field is between 20 Hz and 50 Hz. Each aster is comprised of ferromagnetically ordered chains of microparticles. The frequency of the external magnetic field is used to tune a characteristic size of the asters. The size of aster is closely related to the wavelength of waves propagating at the interface between two fluids, as illustrated in FIG. 1*g*. Varying the frequency of an external magnetic field, thus altering the wavelength of the propagating waves, and, therefore, control the size of asters. Asters are dynamic by nature: they exist only while energy is supplied to the system. Depending on the concentration of the particles and the amplitude of the a.c. magnetic field, asters can further organize into periodic 2D arrays (membranes shown in FIG. 1*c*), or linear trains (shown in FIGS. 1*d* and 1*e*). FIGS. 1*c*-1*e* are micrographs showing asters self-assemble into more complex structures including lattices (or arrays) of asters (c), linear hybrids composed of asters alternating with linear segments (d), and linear trains (e). FIG. 1*f* is a phase diagram illustrating different states of an active magnetic colloid versus magnitude of the ac magnetic field, wherein region 1 depicts asters; region 2 corresponds to linearly ordered structures (magnetic snakes); particles form dense clusters when in Regions 3 and 5; region 4 indicates a wide hysteretic domain where asters co-exist with linear segments. FIG. 1*g* is a graph of frequency dependence of the lattice constant for arrays formed by asters, wherein the dashed line shows the dispersion relation (Eq. 1) for interfacial waves.

In one embodiment, dynamic self-assembly is caused by the interactions between ferromagnetic particles responding to an external periodic magnetic field and both self-induced interface deformations and hydrodynamic flows in the bulk of the liquids. In one embodiment, an alternating current magnetic field is used and usage of a direct current magnetic field forms colloidal crystals instead of the described structures. The surface deformations are not imposed, they are an outcome of the ac magnetic field acting on magnetic particles. A short-range magnetic order, governed by dipole-dipole magnetic interactions between the particles, promotes the formation of chains. These chains, rocking periodically in a response to an a.c. vertical magnetic field (if the field is not vertical, the structures may drift), deform the interface and lead to a resonant excitation of interfacial waves with the wavelength determined by the corresponding dispersion relation, equation (1) set forth below.

In addition, the periodic oscillations of the interface (of the two liquids) at the frequency of the applied magnetic field f excite quasi-static hydrodynamic streaming flows owing to the non-negligible interia of the fluids (the typical Reynolds number for the asters is of the order of 10). These streaming flows are a manifestation of well-known Rayeigh or acoustic streaming phenomenon for oscillatory fluid motions. The waves and self-induced streaming flows provide a necessary feedback mechanism that leads to the formation of asters and arrays. Self-induced flow resulted in a long-range attraction between magnetic chains and caused concentration. Because the magnetic forces (dipolar) and self-induced hydrodynamic flows (quadrupole) have fundamentally different symmetry, the resulting patterns are very different from those arising from the magnetic forces alone. Consequently, the inter-aster distances (lattice constant) in array of asters defined by the dispersion relation for the waves at the interface between two liquids, $$\omega^2 = k\left(\frac{\rho_1 - \rho_2}{\rho_1 + \rho_2} g + \frac{\sigma}{\rho_1 + \rho_2} k^2\right) \tag{1}$$

Here, the wavenumber, is the angular frequency, $\rho_1$ and $\rho_2$ are the densities of the two liquids ($\rho_1 > \rho_2$), and g and $\sigma_{12}$ are the gravitational acceleration and interfacial tension respectively. The array's lattice constant as well as the wavelength of linear snake-like objects accurately approximates the dispersion relation (FIG. 1*g*) over a wide range of frequencies f, with the interface tension $\sigma_{12}$=20.3 mNm$^{-1}$ being a fitting parameter. That value of $\sigma_{12}$ is smaller than the air-water surface tension ($\sigma$=75 mN/m) because the presence of the second fluid significantly reduces the interfacial tension (method). For the conditions of set forth in the examples below, the relative density contrast $(\rho_1-\rho_2)/(\rho_1+\rho_2)$~0.03 was always small. Thus, the contribution from the gravitational part of the dispersion relation (first term in Eq. (1)) is negligible compared with the interfacial part (second term).

The arrangement of chains within an aster is governed by the self-induced hydrodynamic streaming flows and dipole-dipole repulsion of chains. In contrast to magnetic snakes observed at liquid-air interfaces, the presence of the top liquid drastically changes the overall force balance and, correspondingly, the outcome of a dynamic self-assembly. Specifically, an excited circular wave leads to the formation of radial ordering of the magnetic chains. The chains decorate the slopes of the self-induced circular standing wave. A schematic view of an aster is shown in FIG. 2*a*. In certain embodiments, the chains can be positioned on different slopes of the same wave, leading to a broad aster size distribution (FIG. 2*b*); the size distribution seems to be close to a normal distribution (FIG. 2*c*). In one embodiment, the positioning of particles on different slopes is determined by initial concentration of magnetic particles The hydrodynamic signature of asters has been further analyzed by a particle image velocimetry (as further described in the examples below). Asters generate large-scale three-dimensional (3D) toroidal streaming flows in both liquids, as shown schematically in FIG. 2*d*. This result is in stark contrast to the quasi-two dimensional flows created by magnetic snakes at a liquid-air interface. Fluid jets, pointing perpendicular to the interface, emanate in both top and bottom liquids. If the magnetic field is other than vertical, the angle respective to the interface will vary and the structure will be deformed relative to the shape exhibited by a vertical magnetic field. FIGS. 2*e* and 2*f* show the amplitude of the flow velocities created by an aster in the bottom liquid (flow in the upper layer has similar structures). The jet's velocity can reach a magnitude up to 2 cm s$^{-1}$ and depends on the frequency of the applied magnetic field (higher frequency yields faster jet flows). The toroidal organization of the aster's hydrodynamic flow revealed in FIGS. 2*e* and 2*f* implies that the aster is a local sink for particles trapped at the interface: the interfacial flow draws these particles towards the aster.

In one embodiment, the asters are composed of ferromagnetically ordered chains of microparticles decorating circular interfacial wave. This arrangement implies two permissible magnetic configurations, aster and anti-aster (flavou): magnetic moments pointing inwards, towards the centre of the aster (FIG. 3*a*), and outwards (anti-aster), FIG. 3*b*. Both types of structures are present in the system. In one embodiment, asters and anti-asters appear with equal probability. Because asters and anti-asters respond differently on in-plane magnetic field, they can be separated and asters of a certain sign can be "filtered". Asters and anti-asters respond differently to an in-plane static magnetic field. FIG. 3*c* illustrates the response of the aster (top) and anti-aster (bottom) to a 14 Oe in-plane magnetic field: both types of structures are deformed by the in-plane field, whereas the direction of opening depends on the asters' type.

On removal of the in-plane field, the structures close down and recover their initial shapes. Asters and anti-asters, when located close to each other, can exchange particles owing dipole-dipole attractive forces between their chains. If both asters have a similar size, a dynamic equilibrium is established: particles in the contact region constantly change their 'ownership', (FIG. 3*d*). However, if one of the structures is significantly larger, the smaller one is eventually absorbed. This absorption process can be stimulated by a small applied in-plane magnetic field.

The aster's shape change in a response to an applied in-plane magnetic field results in a surprising phenomenon: controlled locomotion. The aster's shape is determined by a fine balance between particle interactions and self-induced hydrodynamic flows: for an axi-symmetric aster the flow is also symmetric and no motion of the aster's center-of-mass occurs. Thus, the deformation of the aster's shape deformation by an external field inevitably leads to the breakdown of the axial symmetry of the hydrodynamic flow and the onset of self-propulsion. Direction of locomotion can be controlled by the direction of magnetic field. A change in the orientation of the magnetic field will produce change in two-dimensional motion of a structure, such as an aster. Reversing the direction of magnetic field reverses the direction of locomotion The propulsion speed depends on the aster's asymmetry (i.e. deformation), controlled in turn by an applied in-plane magnetic field (FIG. 4*a*). The dependence is non-monotonous. Initially, the aster's deformation increases with the increase of the in-plane field, resulting in an increase in propulsion speed (FIG. 4*a*). The speed reaches its maximum at some field (about 10 Oe in the exampled ploted in FIG. 4*a*) and then falls off with a further increase of the applied in-plane field. In the limiting case of a fully opened aster, the flow becomes symmetric again and the propulsion speed vanishes at a critical field $H_c \approx 22$ Oe. As further calculated and explained below, the observed non-monotonous dependence of the aster's speed V versus the in-plane magnetic field H is in good agreement with the theoretical prediction $V \sim H (H_c^2 - H^2)$. The swimming direction depends on an aster's type: asters and anti-asters swim in opposite directions. A remarkable feature of these self-assembled swimmers is that their direction of propulsion and shape can be remotely controlled by the field direction rather than the field gradient, making them easy to manipulate.

Figure 4B:
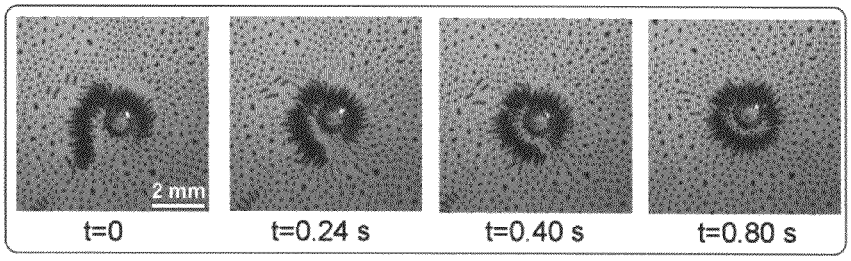
Figure 5A:
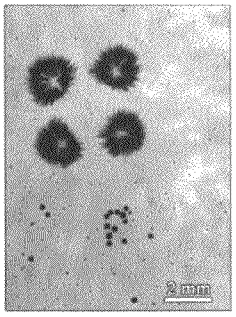
FIGS. 5*a*-5*d* show the collection, encaging, and transport of particles by a cluster of asters.
Figure 5B:
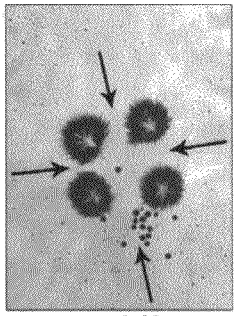
Figure 5C:
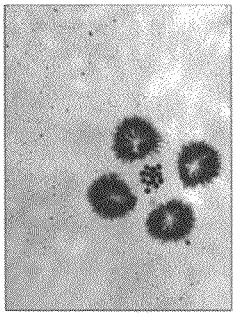
Figure 5D:
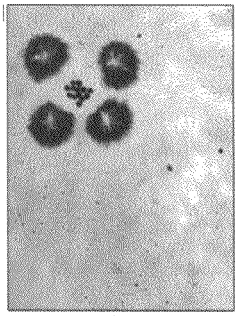

The ability to control the opening of asters and their, speed and direction of propulsion allows one to manipulate non-magnetic particles at the interface. Opening of an aster is controlled by the magnitude of in-plane magnetic field, see FIG. 4*a* Asters and aster arrays membranes, controlled remotely by an in-plane magnetic field, capture, transport, and position target particles. To do that, a dc magnetic field is applied parallel to the interface. Changing the direction of the field, the direction of locomotion can be controlled, changing the magnitude of the magnetic field controls the speed of locomotion and opening of the aster. By changing the direction and the amplitude, an opened aster can be brought in the proximity of target particle. Then the magnitude of the field is decreased, and the aster closes around the particle. By applying smaller magnetic field (below opening value), the aster with a particle can be transported in a desired location. Then applying magnetic field above opening value, the particle is released. In the illustrated examples, each target particle was 2-3 times heavier than the total mass of all the particles in the aster. In one embodiment, the size of the particle should not exceed the size of the aster, otherwise it cannot not capture it inside. The particle should not be too heavy, otherwise it will sink to the bottom. FIG. 4*b* features a sequence of images demonstrating a capture event. The aster is opened by an in-plane field created by a set of external magnetic coils, moved to the location of a cargo particle (glass bead in the experiment), then closed around the particle. The aster and captured particle are then transported to the location of interest.

Self-assembled arrays and clusters of asters provide additional functionality not available from a single aster. An array membrane can collect, encage, and transport particles of interest in the interstitial space between the individual asters. FIGS. 5*a*-5*d* demonstrate such a functionality of an array formed of four asters. In one embodiment, the array is kept together due to interaction with the interfacial waves generated by each aster: aster are located at the wave crests which are separated by a wavelength of interfacial waves. Particles are retained at the interstitial space by the self-induced flow; the interstitial space is a sink for self-induced flow (FIG. 5).

Figure 6:
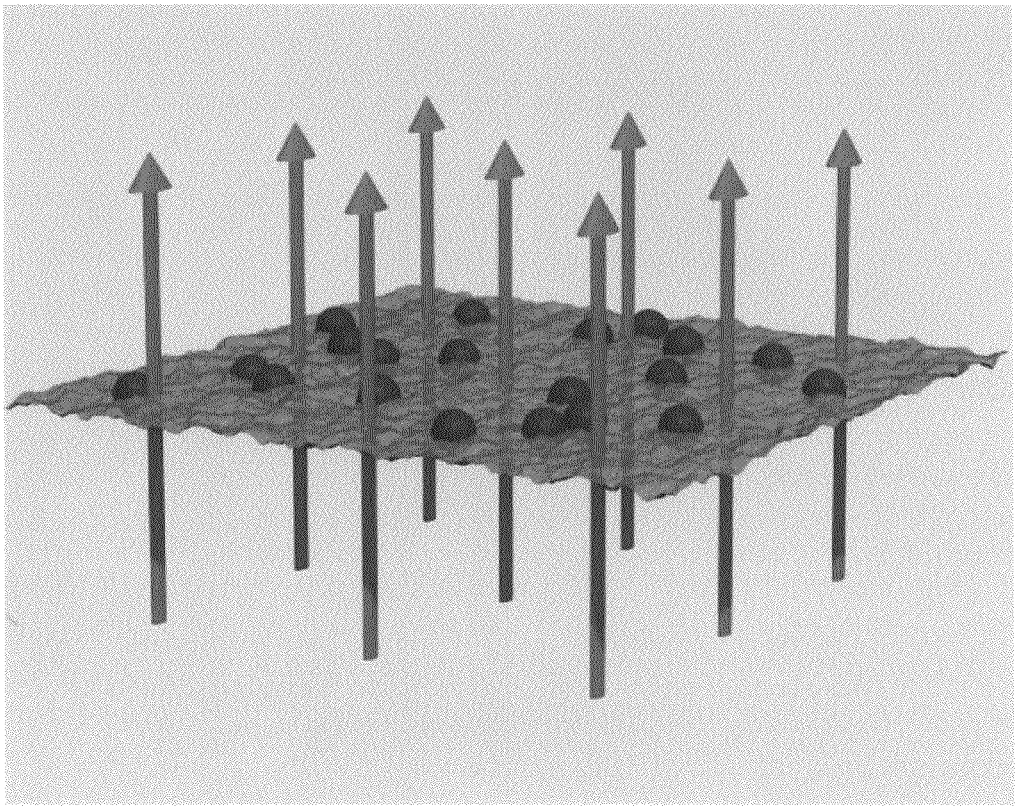
FIG. 6 illustrates magnetic agitation of magnetic particles at a liquid/air interface. The particles in the illustrated example are 35-90 micrometer Nickel particles supported by surface tension. The magnetic agitation was accomplished by vertical ac magnetic field of 10-200 Hz.

FIG. 6 illustrates magnetic shaking of magnetic particles at a liquid/air interface. The particles in the illustrated example are 35-90 micrometer Nickel particles supported by surface tension. The magnetic shaking was accomplished by vertical ac magnetic field of 10-200 Hz. Magnetic and hydrodynamic interactions are observed.

Figure 7A:
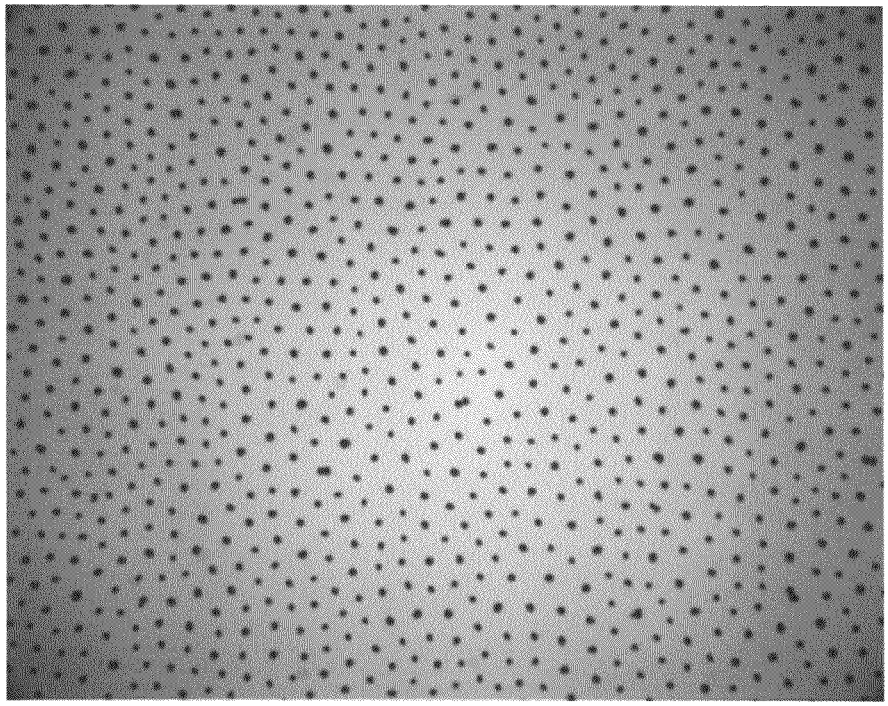
FIGS. 7*a* and 7*b* illustrate that colloidal crystals are possible for dc (constant) magnetic field and linear snakes are possible for ac (alternating) magnetic field. In the illustrated example, Hac=100 Oe, 50 Hz with 90 micrometer nickel spherical particles.
Figure 7B:
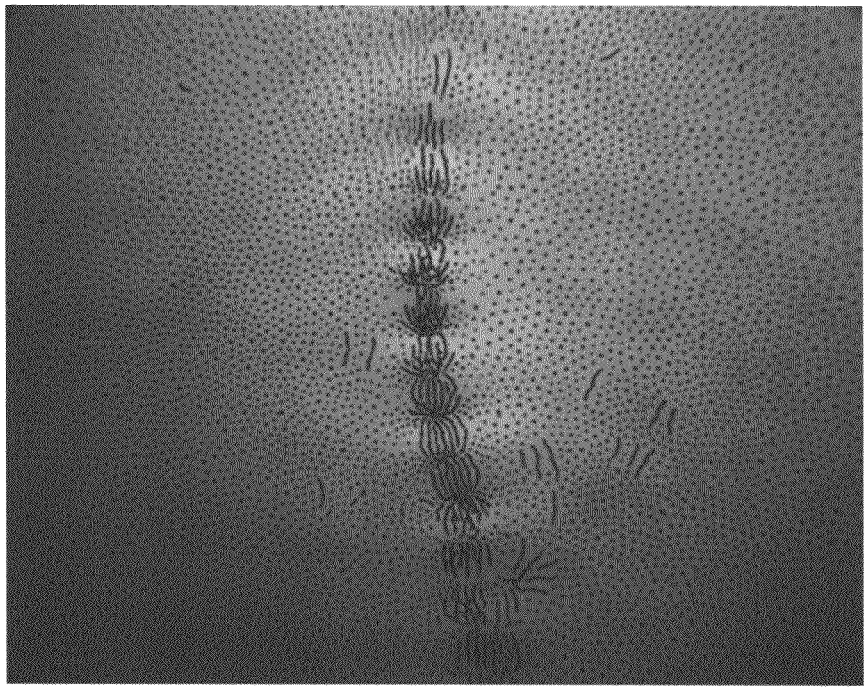

FIGS. 7*a* and 7*b* illustrate that colloidal crystals and snakes are possible. In the illustrated example, Hac=100 Oe, 50 Hz with 90 micrometer nickel spherical particles.

Figure 8A:
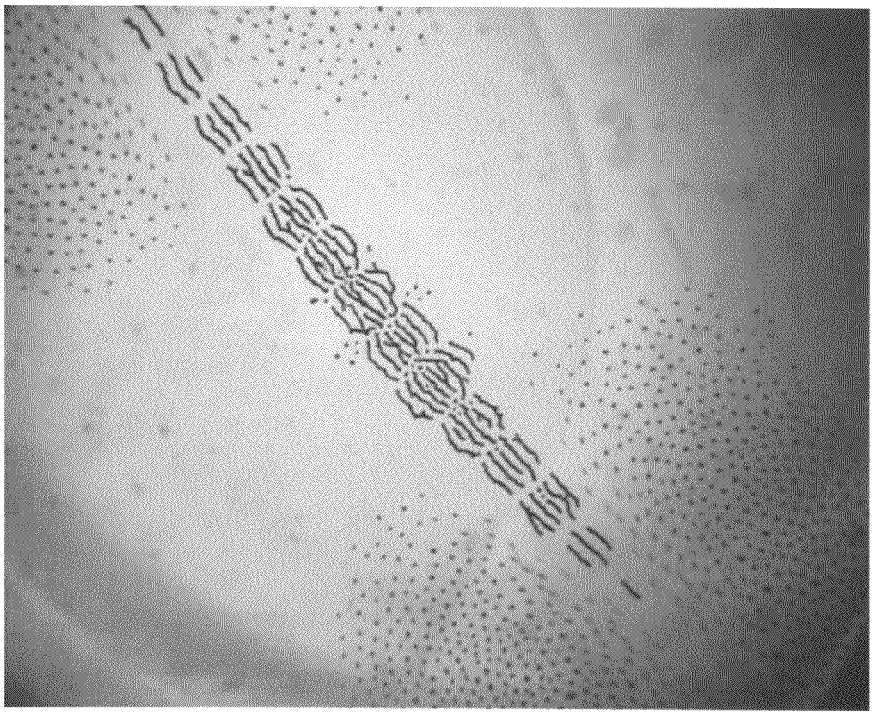
FIGS. 8*a*-*c* illustrate examples where large-scale surface vortex flows are created.
Figure 8B:
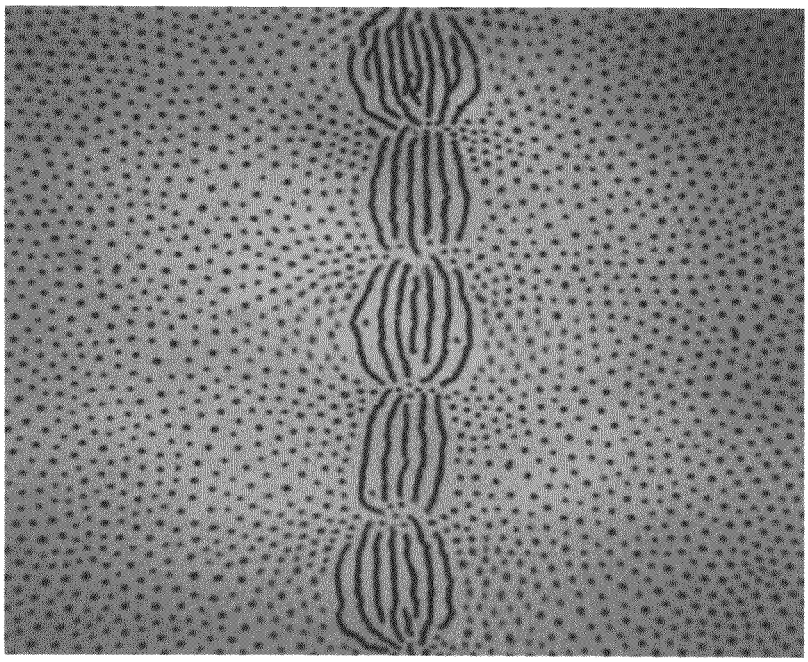
Figure 8C:
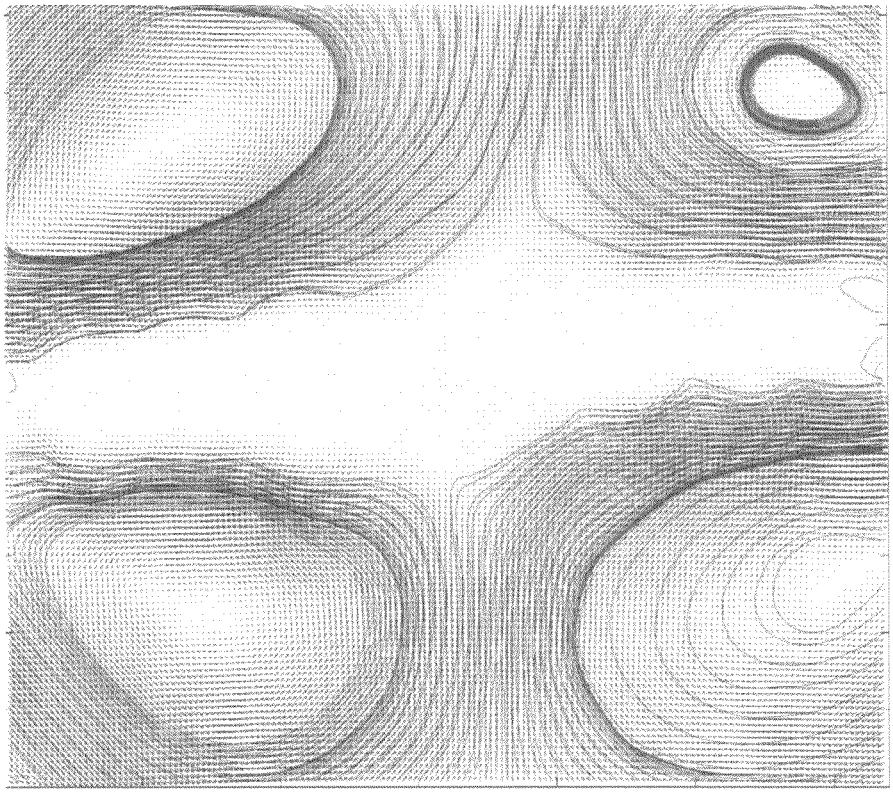
Figure 11:
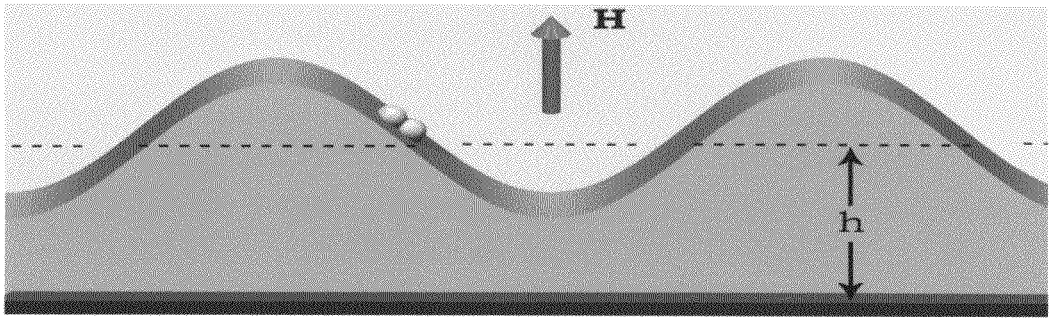
FIG. 11 is an illustration of an embodiment producing an underwater snake and aster structures at the interface between two immiscible liquids.

FIGS. 8*a*-*c* illustrate examples where large-scale surface vortex flows are created. FIG. 8*a* Hac=100 Oe; 50 Hz. FIG. 11*b* Hac=110 Oe, 60 Hz. FIG. 11*c* illustrates the quadrupole vortex structure observed. Each tail generates a pair of counter rotating vortices. The flow velocity was observed as 5 cm/sec.

Figure 9A:
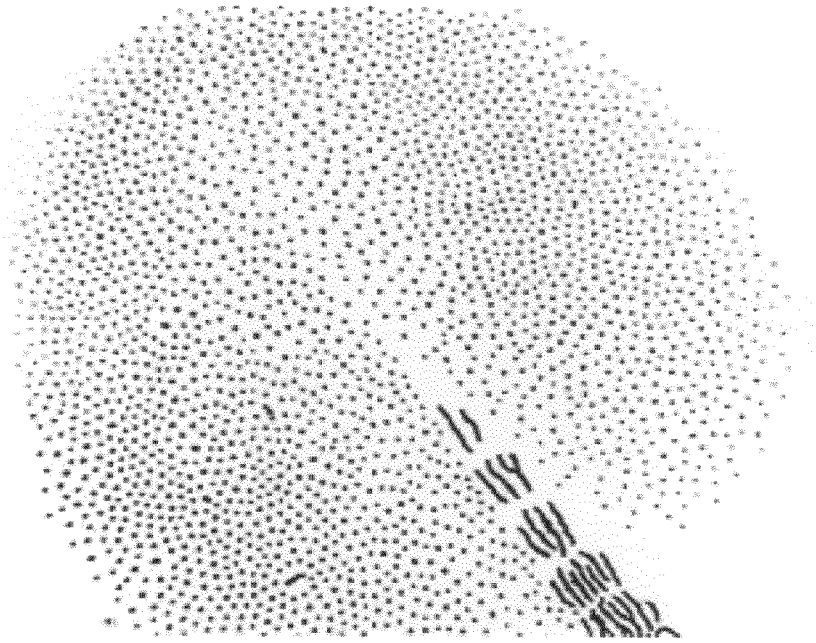
FIGS. 9*a*-*c* illustrates self-assembled pumps in accordance with the present invention.
Figure 9B:
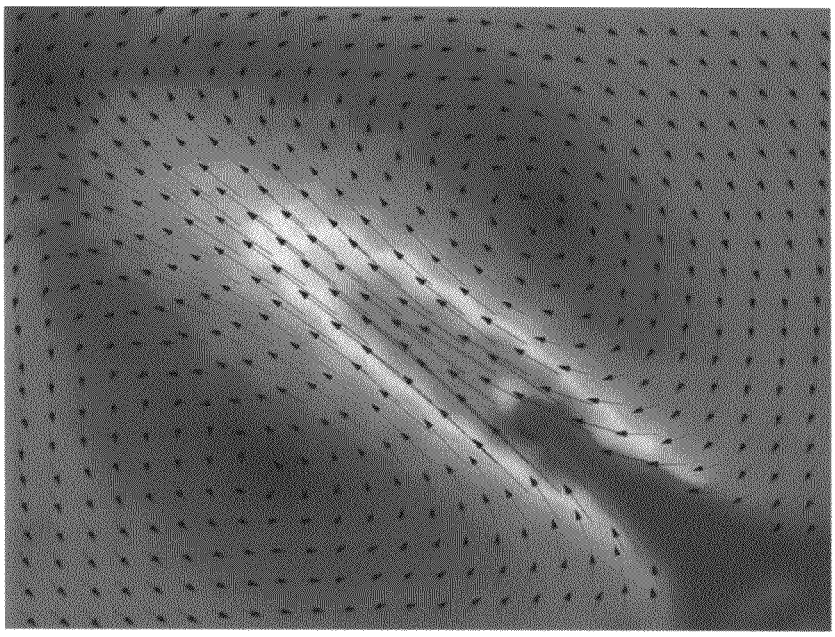
Figure 9C:
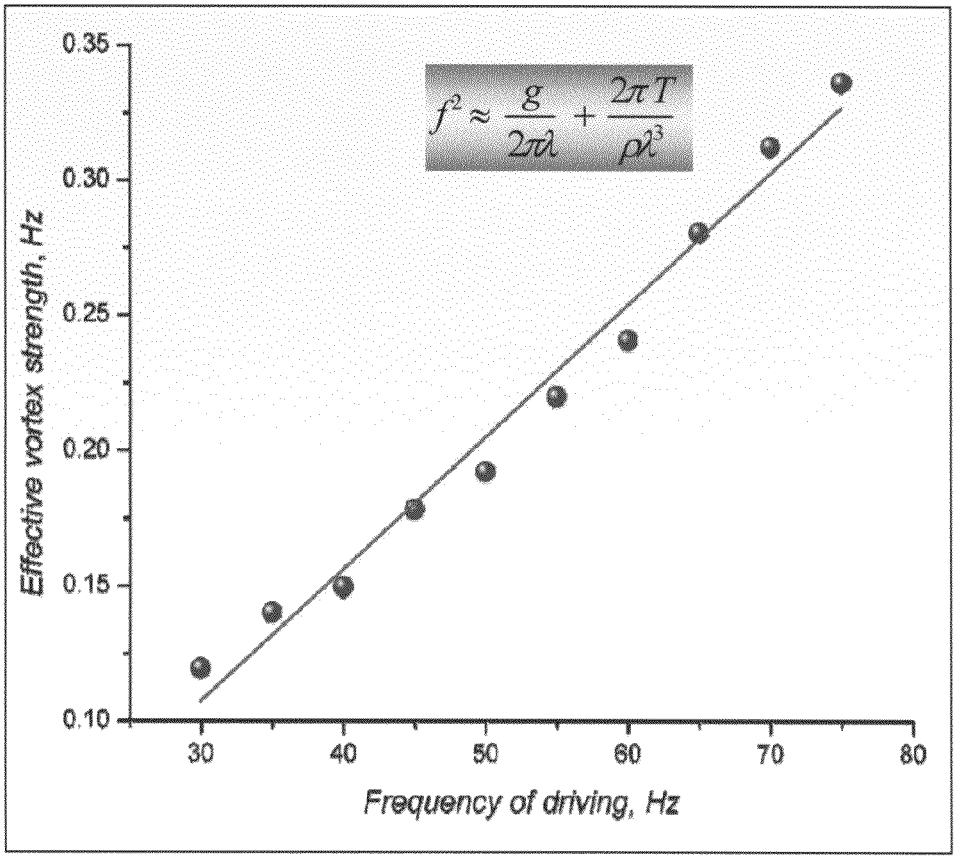

In one embodiment, the structure may be a pump. FIG. 9 illustrates self-assembled pumps in accordance with the present invention. FIG. 9 *a* illustrates a micrograph of the assembled structure. The tail of the pump operates to create fluid flow. The fluid velocity will increase with frequency. FIG. 9*b* illustrates the flow velocity profile of the pump of FIG. 9*a*. FIG. 9*c* is a graph of vertex strength vs frequency of driving.

Figure 10:
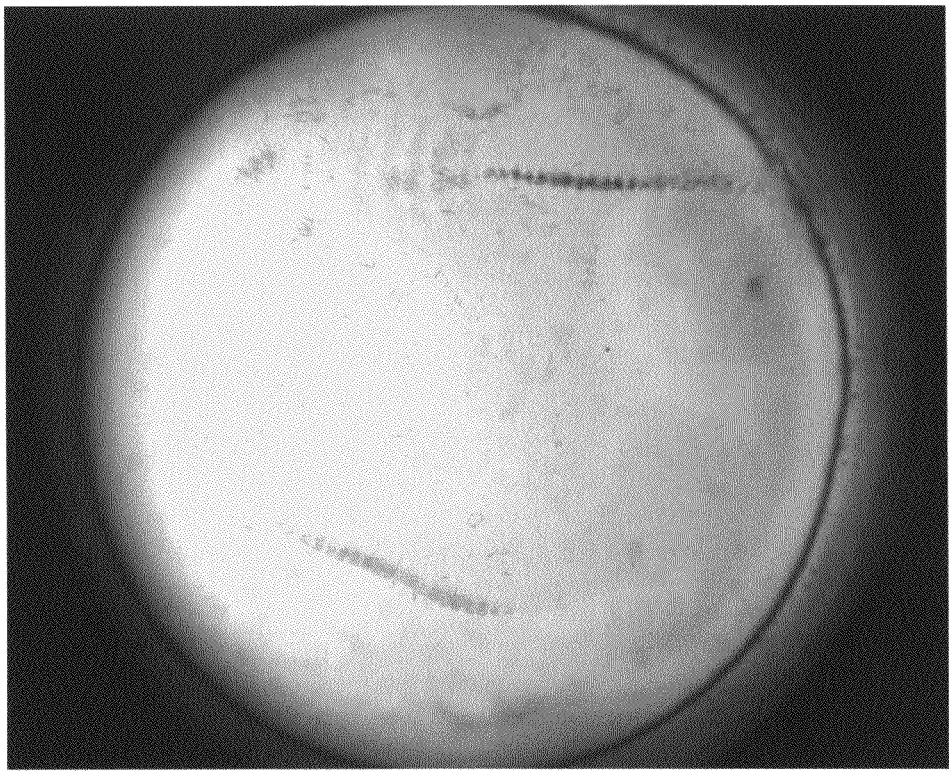
FIG. 10 illustrates two generally linear structures (snakes) having two tails. Symmetry between the two tails is broken spontaneously. If one tail will win out, and direct motion of the structure, if the frequency is high enough.

In one embodiment, the structure may exhibit movement. FIG. 10 illustrates two generally linear structures having two tails. Symmetry between the two tails is broken spontaneously. If one tail will win out, and direct motion of the structure, if the frequency is high enough.

In one embodiment, the structure may be formed under water. The structure is formed at the liquid-liquid interface, such as oil and water. A reduced density contrast results in a reduction in size. FIG. 1 *g* illustrates the dispersion relationship for an embodiment of underwater snake.

Figure 15:
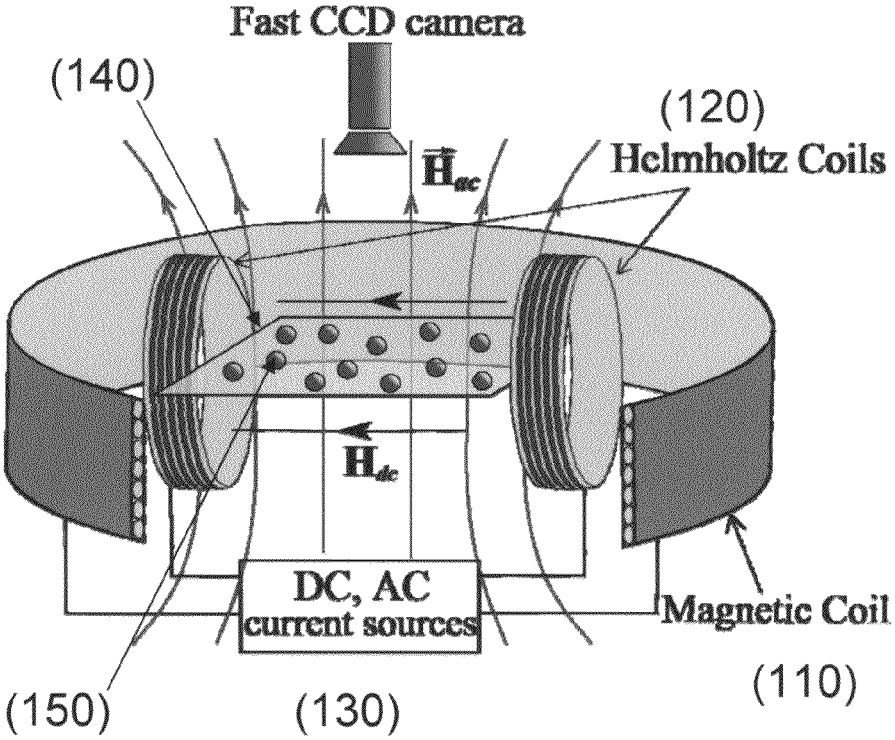
FIG. 15 illustrates, for one embodiment, a system for generating self-assembled structures.

FIG. 15 illustrates one embodiment of a system for generating self-assembled structures. An ac magnetic field $H_{ac}$ is created by a large magnetic Helmholtz coil 120. The ac magnetic filed is created by transmitting ac electric current from ac current source 130. The container 140 with two liquids is placed inside the coil 120, the interface between two immiscible liquids is positioned at the middle part of the Helmholtz coil ensuring that the magnetic field is uniform and perpendicular to the interface. FIG. 15 also shows schematically magnetic particles 150 floating at the interface between two fluids. The dc magnetic field $H_{dc}$ is created by two pairs of orthogonal Helmholtz coils 120 (only one pair is shown in the figure). The Helmholtz coils 120 are placed either inside a ac magnetic coil 110 or outside, with the magnetic coil 110. Two pairs of orthogonal coils are needed to create in-plane dc magnetic field with arbitrary orientation. The orientation is controlled by changing independently dc electric currents in each pair of coils. To control direction of swimming and opening of asters two sets of helholtz coils 120 are used to apply field parallel to the interface.

A. Examples and Methods

Nickel spherical microparticles with an average size of 90 μm (Alfa Aesar Company) were used in the experiments. Microparticles were dispersed at the interface between two immiscible liquids. The bottom liquid was a 5 cm deep saturated solution of $Na_2SO_4$ in water, with density ρ=1,136 kgm-$^3$. Silicone oil poly(dimethylsiloxane) from Dow Corning Corporation, with density ρ=950 kgm-$^3$ viscosity $\eta=0.2\cdot10^{-4}$ m$^2$-1s and surface tension o=20 mNm$^{-1}$ at 25° C. was used as a top liquid (3 mm deep). The reported interfacial tension between pure water and silicone oil is of the order of $o_{12}$=40 mNm$^{-1}$, the inter facial tension can be as low as 10 mNm because of the presence of surfactants, salt, and interface contamination. The colloidal suspension was energized by a uniform vertical alternating magnetic field, $H_{ac}=H_0$ sin (2π ft), applied perpendicular to the interface. The amplitude of the ac magnetic field $H_0$ was in the range of 50-250 Oe and the frequency f was in the range of 10-120 Hz. A static in-plane magnetic field up to 40 Oe was created by two pairs of orthogonal precision Helmholtz coils. The experimental set-up was built as originally described in Snezhko A., Aranson I. S, & Kwok W.-K. Surface wave assisted self-assembly of multidomain magnetic structures. Phys. Rev. Lett. 96, 078701 (2006), which is incorporated by reference herein. Particle image velocimetry (PIV) was performed in the bottom liquid layer using a laser sheet illumination technique 30. Tracer particles (Kalliroscope tracers, PM-01, Kalliroscope) were introduced into the bulk of the bottom layer. Vertical and horizontal slices of the flow pattern were acquired. Horizontal slices were taken at a depth of 0.5 mm below the interface. 1 mm (Ceroglass GSR-11) and 0.4 mm (Ceroglass SLYTZ-5) glass beads were used as cargo particles to demonstrate simple robotic functionality of asters and membranes.

The force exerted by an aster on a 1 mm spherical bead can be estimated from the drag force acting on a moving sphere in a viscous media. For a d=1 mm bead moving with a speed V of approximately 1 cm s$^{-1}$ in a water/silicone oil mixture (ratio of viscosities 1:20, so the main contribution to the friction comes from the more viscous oil layer, the viscous drag force is then $F=3\pi dV\eta\approx10^{-6}$ N. Correspondingly, the torque can be estimated from the maximal rate of rotation of the aster in response to a rotation of the in-plane magnetic field, which is in most of the cases about w=1-2 Hz. The viscous torque is then given by $T=\pi d^3 w\eta\approx10^{-9}$ Nm.

B. Derivation of the Velocity-Field for Swimming Asters

Evaluation of structure's drift velocity as a function of the in-plane magnetic field is a formidable problem: it is intrinsically nonlinear due to the nature of large-scale (rectified) flow generated by an aster. In one aspect of the invention, a simplified yet non-trivial model captures salient features of the observed phenomenon: the onset of motion in a response to the in-plane magnetic field and cessation of motion with further increase of the field.

Instead of the three-dimensional Navier-Stokes equation for an aster the one-dimensional Burgers equation with two point-point pressure sources—stresslets (since no net external force is applied to the aster, the point sources should be force dipoles) is considered. Despite its nonlinearity, the equation is fully integrable by the means of the Hopf-Cole transformation. The equations is of the form:

$$\partial_t u + 2u\partial_x u = \eta\partial_x^2 u + \frac{\partial}{\partial x}(m_1\delta(x - Vt) + m_2\delta(x - L - Vt)) \tag{2}$$

Here u denotes the hydrodynamic velocity. Note that incompressibility condition is not enforced: the non-zero 1D flow divergence $\delta_x u\neq0$ can be interpreted as a flow generation in the orthogonal direction. Viscosity η and the distance between sources L is scaled to 1. In this simplified description only a slowly-varying (i.e. averaged over the period 2π/f of the applied vertical magnetic field) large-scale flow generated by an aster is considered. The time-periodic component of the flow decays exponentially away from the source and does not contribute directly to the drift velocity.

The nonlinear equation was selected to describe the self-interaction of aster's rectified flows. Aster is replaced by an asymmetric rigid dumbbell: two point pressure sources with amplitudes $m_1,m_2>0$ located at the distance L and drifting as a whole with a velocity V, see FIG. 12. The amplitudes $m_1$, $m_2$ are assumed to be proportional to the total magnetic moments parallel ($m_1$) and antiparallel ($m_2$) to static in-plane magnetic field H. Thus, $m_1=m_2$ corresponds to zero field and aster's asymmetry $m_1-m_2$ is proportional to the in-plane field H.

Figure 12:
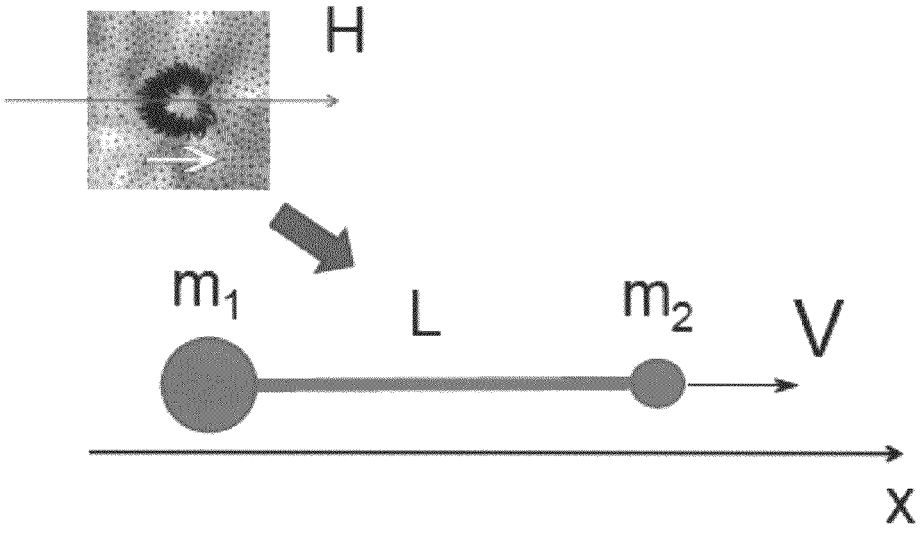
FIG. 12 is an illustration of a model, for one embodiment, where the aster is replaced by a rigid asymmetric dumbbell: two particles with magnetic moments $m_1$ parallel and $m_2$ anti-parallel to the in-plane magnetic field H. The particles are rigidly connected and maintained at the distance L (size of the aster). The viscous drag force is proportional to particle's size, and, correspondingly, its magnetic moment $m_{1,2}$.
Figure 13:
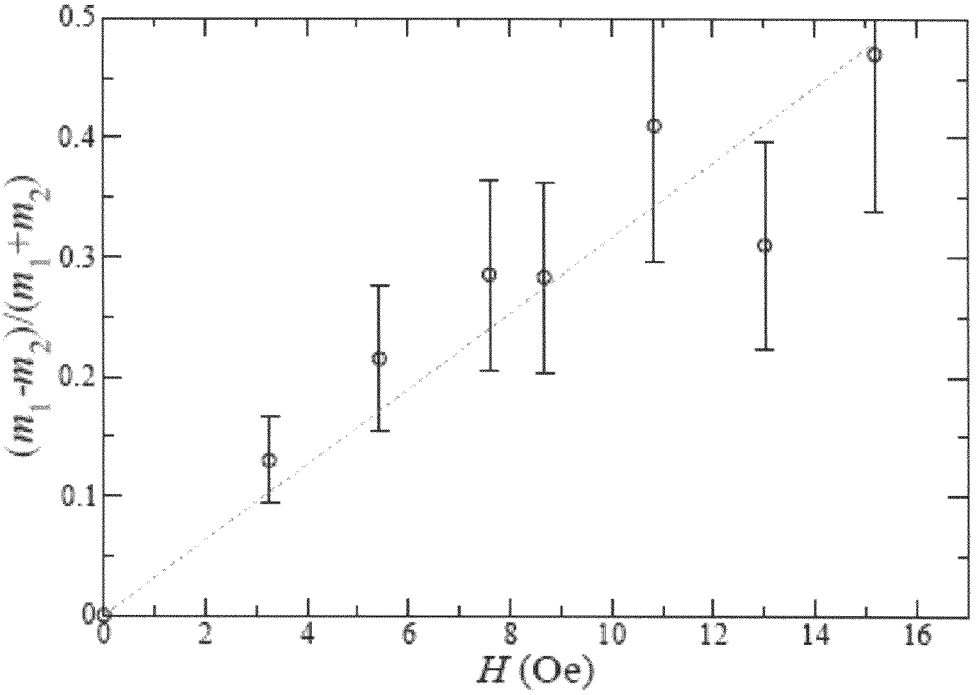
FIG. 13 is a graph of, for one embodiment, an aster's relative asymmetry parameter $(m_1-m_2)/(m_1+m_2)$ vs the in-plane magnetic field H for the data shown in FIG. 4*b*. The dashed line is a linear fit $(m_1-m_2)/(m_1+m_2)=\text{const}\times H$.

This assumption that aster's asymmetry $m_1-m_2$ is proportional to the in-plane magnetic field H was validated, see FIG. 12. The experimental data shown in FIG. 4*a* was processed. To calculate quantities $m_{1,2}$, the total number of particles with the component of their magnetic moments parallel ($m_1$) and anti-parallel ($m_2$) to the field was extracted from the experimental images of individual asters, the result is shown in FIG. 13. The overall dependence is consistent with a linear law.

Thus, for this embodiment, the model describes a cross-section through the center of an aster in the direction of the in-plane field H. In isolation (e.g. $m_2=0$, it corresponds to a completely opened aster or a plane segment with the magnetic chains parallel to the in-plane field H), each source does not drift and creates an anti-symmetric flow: $u=-m_1/2$ for $x<0$ and $u=m_1/2$ for $x>0$. The drift emerges as a result of a nonlinear interaction between the flows generated by each source.

The drift velocity V is determined from the force balance condition exerted by the flow on each point source. The sources are assumed to be rigidly connected and maintaining the distance L in the course of motion. To determine the drift velocity V, the total force F exerted by the flow on two particles is stated as zero (no external force is applied to the aster). Thus the total force F is of the form (includes contributions acting on each particle and proportional to relative velocity u-V):

$$F=\kappa(m_1(\langle u_1\rangle-V)+m_2(\langle u_2\rangle-V))=0 \quad (3)$$

Here $\langle u_{1,2}\rangle$ are the mean flow velocities at the location of each particle, κ is the mobility constant. Because the flow is discontinuous at the δ-functions, $\langle u_{1,2}\rangle=(u_{1,2}^{+}+u_{1,2}^{-})/2$ where $u^{\pm}$ denotes the values of flow right/left of the δ-function. Here it was set that viscous drag on each particle is proportional to its size (compare to the Stokes law) determined in turn by the corresponding magnetic moment $m_{1,2}$. Therefore, excluding V from Eq. (2), expression for the drift velocity is obtained:

$$V=\frac{m_1\langle u_1\rangle+m_2\langle u_2\rangle}{m_1+m_2} \quad (4)$$

If the drift velocity V is small compared to u, $\eta_t u$ in Eq. (1) may be neglected. This technical assumption allows significant simplification of the calculations. Replacing x→x−Vt, and dropping $\partial_t u$ term, integrating Eq. (2) yields $$\partial_x u-u^2+m_1\delta(x)+m_2\delta(x-1)=-\bar{u}^2=\text{const} \quad (5)$$

where $\bar{u}>0$ is an integration constant to be determined. The solution for x<0 is $u=-\bar{u}$ and $u=\bar{u}$ for x>1. For 0<x<1 the solution is obtained by integration of Eq. (5):

$$u=-\bar{u}\tan h(\bar{u}(x-x_o)) \quad (6)$$

where $x_0$ is another constant to be determined. This solution has to be matched at the points x=0, 1 to the solution outside the interval using jump conditions $u_{1,2}^{+}-u_{1,2}^{-}=m_{1,2}$ at the δ-functions. From integration over the δ-functions the following is obtained:

$$-\bar{u}\tan h(\bar{u}(-x_0))+\bar{u}=m_1 \quad (7)$$

$$\bar{u}\tan h(\bar{u}(1-x_0))+\bar{u}=m_2 \quad (7)$$

Eqs. (7) uniquely define the constants $\bar{u}$, $x_0$ as functions of $m_{1,2}$, and, in turn, yield an explicit expression for the drift velocity V. Note that if $m_2=0$ correct flow is receovered for a single source: $u=-m_1/2$ for x<0 and $u=m_1/2$ for x>0. Explicit form for V (using Eq. (4) and Eq. (8)) is $$V=\frac{m_1(\bar{u}\tanh(\bar{u}x_0)-\bar{u})+m_2(\bar{u}-\bar{u}\tanh(\bar{u}(1-x_0)))}{m_1+m_2}=\frac{m_1-m_2}{m_1+m_2}(m_1+m_2-2\bar{u}) \quad (8)$$

Figure 14:
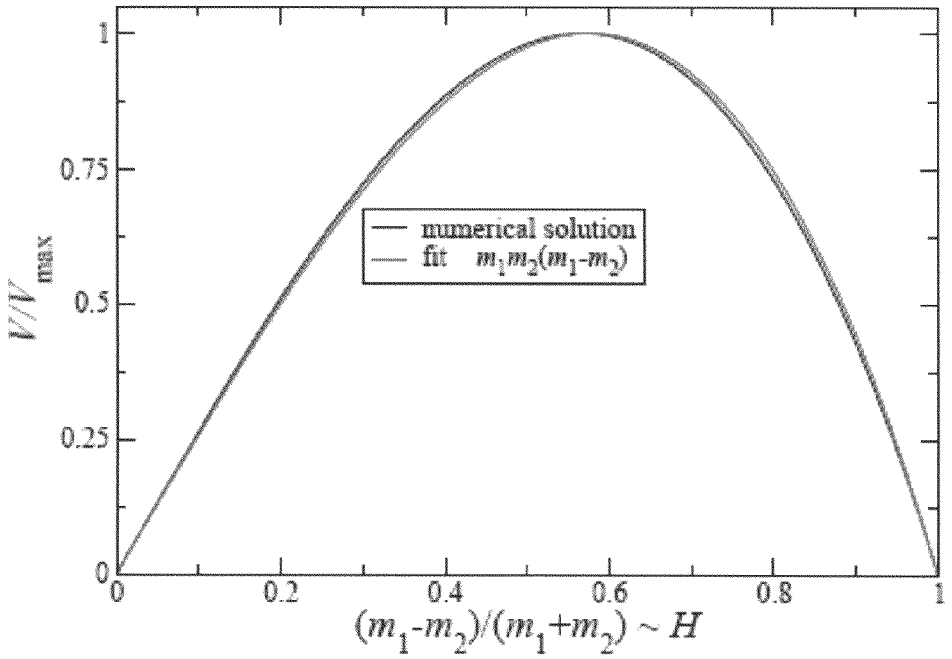
FIG. 14 illustrates, for one embodiment, an aster's drift velocity vs normalized magnetic moments difference $(m_1-m_2)/(m_1+m_2)$, and $m_1+m_2=1$ obtained from one-dimensional hydrodynamic theory.

Solving numerically transcendental Eqs. (7) and plugging $x_0$, $\bar{u}$ into Eq. (8) obtains dependence of the drift velocity V vs $m_{1,2}$ shown in FIG. 3. Note that V→0 if $m_1\to m_2$ (small field) or if $m_2\to 0$ (large field) because in this case $\bar{u}\to m_1/2$. Therefore, for $m_2\to 0$, $V\sim m_1m_2(m_1-m_2)\to 0$, Similar expression is obtained for $m_1\to 0$, Simple approximation $V\sim m_1m_2(m_1-m_2)$ valid in all three limits ($m_1-m_2\to 0$, $m_1\to 0$, or $m_2\to 0$) is in good agreement with the numerical solution of Eqs. (7), (8), see FIG. 14. The overall dependence is consistent with the experiment: initial linear increase of the velocity V with H and drop off for larger H.

To fit experimental data, $m_1-m_2=H$ and $m_1+m_2=H_c=\text{const}$. The resulting fitting curve is in a good agreement with the experimental data show in FIG. 4*a*.

$$V\sim m_1m_2(m_1-m_2)\sim H(H_c^2-H^2) \quad (9)$$

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An system for manipulating particles comprising:
- a first liquid and a second liquid, the first and second liquid being immiscible;
- magnetic microparticles dispersed at the interface of the two immiscible liquids; and
- a magnetic source positioned to apply an alternating magnetic field to the dispersed magnetic microparticles.

2. The system of claim 1, wherein the magnetic source is positioned to apply a uniform vertical magnetic field.

3. The system of claim 1, wherein the frequency of the alternating magnetic field is between about 20 Hz and about 50 Hz.

4. The system of claim 1, wherein the microparticles self-assemble to form a structure selected from the group consisting of asters, anti-asters, snakes, and dense clusters.

5. The system of claim 1, further comprising an in-plane magnetic field.

6. The system of claim 5, wherein the in-plane magnetic field is about 10 Oe to about 22 Oe.

7. The system of claim 5, further comprising an aster formed by the magnetic microparticles, the aster having deformation from the in-plane magnetic field and a fluid flow providing locomotion to the aster.

8. The system of claim 5, further comprising an array of asters self-assembled from the microparticles.

9. A self-assembling structure comprising:
- a plurality of magnetic microparticles suspended at a liquid-liquid interface;
- the plurality of magnetic microparticles arranged by dipole-dipole magnetic interactions with an external magnetic field; and
- a deformation resulting in a non-symmetrical shape of the self-assembled structure.

10. The self-assembling structure of claim 9, wherein the microparticles self-assemble to form a structure selected from the group consisting of asters, anti-asters, snakes, and dense clusters.

11. The self-assembling structure of claim 10, wherein the self-assembled structure is an aster.

12. The self-assembling structure of claim 11, wherein the aster has an associated toroidal hydrodynamic fluid flow.

13. A method for magnetic manipulation of self-assembled asters comprising:
- suspending magnetic particles at an interface between two immiscible liquids;
- energizing the ferromagnetic suspension by application of a vertically positioned alternating current magnetic field;
- forming chains of magnetic particles;
- rocking the chains of magnetic particles by action of the alternating current magnetic field;
- deforming the interface; and
- generating a hydrodynamic streaming flow associated with the chains of magnetic particles.

14. The method of claim 13, wherein the chains of magnetic particles are organized as an aster.

15. The method of claim 14, wherein fluid flow is from a periphery of the aster to the center.

16. The method of claim 14, wherein fluid flow is from a center of the aster to the periphery, forming an anti-aster.

17. The method of claim 13, wherein the hydrodynamic streaming forms jets perpendicular to the interface.

18. The method of claim 13, wherein an in-plane static magnetic field is applied.

* * * * *